US011396198B2

(12) United States Patent
Zhou et al.

(10) Patent No.: US 11,396,198 B2
(45) Date of Patent: Jul. 26, 2022

(54) EMBOSSED PRINT MEDIA

(71) Applicant: Hewlett-Packard Development Company, L.P., Fort Collins, CO (US)

(72) Inventors: Xiaoqi Zhou, San Diego, CA (US); Xulong Fu, San Diego, CA (US); Fredrick Muya Makau, San Diego, CA (US); Matthew D. Nuth, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 71 days.

(21) Appl. No.: 15/768,345

(22) PCT Filed: Jan. 19, 2016

(86) PCT No.: PCT/US2016/013878
§ 371 (c)(1),
(2) Date: Apr. 13, 2018

(87) PCT Pub. No.: WO2017/127049
PCT Pub. Date: Jul. 27, 2017

(65) Prior Publication Data

US 2018/0326773 A1 Nov. 15, 2018

(51) Int. Cl.
*B41M 5/50* (2006.01)
*B41M 5/52* (2006.01)
(Continued)

(52) U.S. Cl.
CPC ..... *B41M 5/502* (2013.01); *B41M 1/24* (2013.01); *B41M 5/504* (2013.01); *B41M 5/52* (2013.01);
(Continued)

(58) Field of Classification Search
CPC ..... B41M 5/502; B41M 5/52; B41M 5/504; B41M 1/24; B41M 5/5281; B41M 5/5218;
(Continued)

(56) References Cited

U.S. PATENT DOCUMENTS 5,753,349 A 5/1998 Boswell
6,360,659 B1 3/2002 Newman
(Continued)

FOREIGN PATENT DOCUMENTS

CN 104245337 12/2014
CN 105163947 12/2015
(Continued)

OTHER PUBLICATIONS

Sigma-Aldrich, Specification Sheet, obtained from: https://www.sigmaaldrich.com/catalog/DataSheetPage.do?brandKey=ALDRICH&symbol=11773 (Year: 2019).*
(Continued)

*Primary Examiner* — Brian Handville
(74) *Attorney, Agent, or Firm* — Thorpe North & Western LLP

(57) ABSTRACT

The present disclosure is drawn to embossed print media including a media substrate having a front side and a back side, an embossed image-receiving layer formed on the front side of the media substrate at a coating weight of 3 gsm to 50 gsm, and a fabric liner coupled to the back side of media substrate via an adhesive layer. The embossed image-receiving layer can include a first pigment filler and a first polymeric binder. The adhesive layer can be applied at a coating weight from 20 gsm to 40 gsm and can include a second polymeric binder and a flame-retarding filler.

10 Claims, 4 Drawing Sheets

(51) Int. Cl.
*B44C 1/24* (2006.01)
*B44D 3/18* (2006.01)
*B41M 1/24* (2006.01)

(52) U.S. Cl.
CPC ..... *B41M 5/5218* (2013.01); *B41M 5/5281* (2013.01); *B44C 1/24* (2013.01); *B44D 3/18* (2013.01); *B44D 3/185* (2013.01); *B41M 5/5227* (2013.01); *B41M 5/5236* (2013.01); *B41M 5/5254* (2013.01); *B41M 2205/40* (2013.01)

(58) Field of Classification Search
CPC ..... B41M 5/5254; B41M 5/5236; B41M 5/5227; B41M 2205/40; B44D 3/18; B44D 3/185; B44C 1/24
See application file for complete search history.

(56) References Cited

U.S. PATENT DOCUMENTS

| | | | | |
|---|---|---|---|---|
| 6,409,333 | B1 | 6/2002 | Nishikawa | |
| 7,699,458 | B2 | 4/2010 | Mabbott | |
| 8,071,201 | B2 | 12/2011 | Leenders et al. | |
| 2002/0192436 | A1* | 12/2002 | Voeght | B41C 1/148 428/32.34 |
| 2009/0208675 | A1 | 8/2009 | Nigam | |
| 2011/0039043 | A1* | 2/2011 | Klemann | B41M 5/502 428/32.37 |
| 2014/0044897 | A1 | 2/2014 | Zhou et al. | |

FOREIGN PATENT DOCUMENTS

| | | |
|---|---|---|
| EP | 1089880 | 2/2004 |
| JP | 2005271521 | 10/2005 |
| WO | 0041821 | 7/2000 |
| WO | 2006096831 | 9/2006 |
| WO | 2014158347 | 10/2014 |
| WO | 2015009271 | 1/2015 |
| WO | 2015142313 | 9/2015 |

OTHER PUBLICATIONS

International Search Report dated Oct. 18, 2016 for PCT/US2016/013878, Applicant Hewlett-Packard Development Company, L.P.

* cited by examiner

EMBOSSED PRINT MEDIA

BACKGROUND

Canvas media can be used to support a variety of images, such as analogue oil paintings and digitally printed images. A variety of materials can be used to make canvas media, such as duck fabric, linen fabric, synthetic fibers, and the like. Further, canvas media can have various weights (thicknesses) and weaves (tightness of the individual threads are woven). In some cases, canvas media can be primed prior to printing to achieve a desired image quality.

DETAILED DESCRIPTION

Figure 1:
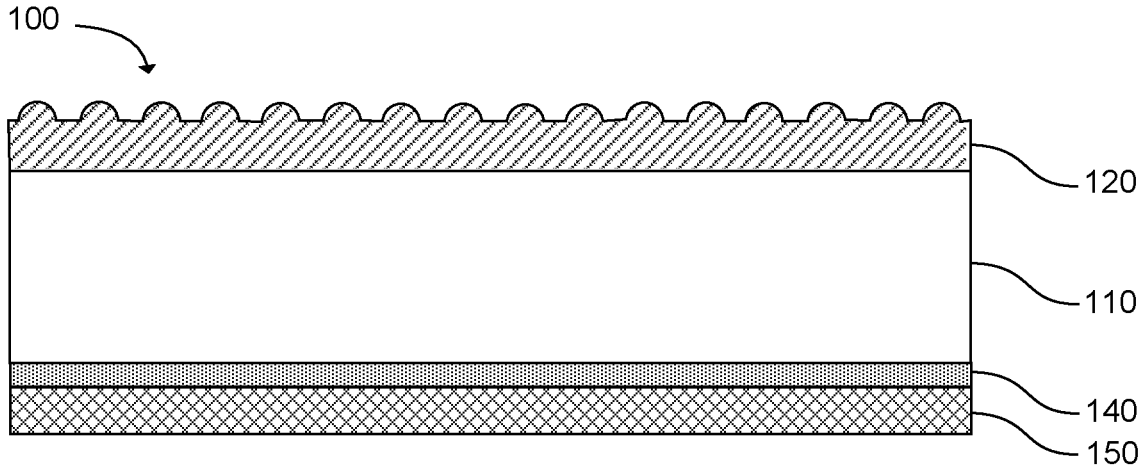
FIG. 1 is a cross-sectional view of an embossed print medium with an image-receiving layer and a fabric liner, but without an abrasion-resistant layer, in accordance with examples of the present disclosure.

The term "canvas" has traditionally served as a generic description for any fabric that is used as a substrate for paintings and painting-like images. However, besides high cost, traditional canvas materials can come with a variety of challenges and can make them unsuitable, particularly for digital printing. One such challenge with traditional canvas materials stems from a tendency to deform under framing strain because these fabric materials are typically woven with a loose weave allowing the material to easily distort. Cracking is another challenge with traditional canvas media. Cracking can occur either at a coating interface or on an image/material interface. Fading of the traditional canvas is another challenge that causes the fabric to deteriorate and become brittle. Further, compared with other imaging media, such as paper, the traditional canvas materials can be expensive.

The present disclosure, in some examples, overcoming a number of these challenges associated with more traditional canvas media. Accordingly, the present disclosure describes a canvas media having embossable layers. More specifically, the present disclosure is drawn to embossed print media that can include a media substrate, an embossed image-receiving layer formed on the media substrate, a fabric liner, and an adhesive layer coupling the media substrate to the fabric liner. In one example, the embossed print media may include an abrasion-resistant layer applied to the embossed image-receiving layer. More specifically, the embossed image-receiving layer can have a coating weight of 3 grams per square meter (gsm) to 50 gsm and can include a first pigment filler and a first polymeric binder. The adhesive layer can have a coating weight of from 20 gsm to 40 gsm and can include a second polymeric binder and a flame-retarding filler. If the abrasion-resistant layer is present, it can be applied at a coating weight of from 3 gsm to 50 gsm and can include a cross-linked polymer network and a second pigment filler, for example.

In some examples, the embossed print medium can be a stretchable print medium, e.g., stretch in one direction or along one axis by up to 5% without tearing or cracking. In some examples, the media substrate can include a polymeric latex. In some examples, the first polymeric binder can have a weight average molecular weight greater than 10,000 Mw. In some examples, the cross-linked polymer network can include a polyurethane, an epoxy, or a combination thereof. In some examples, the fabric liner can include from 20 wt % to 100 wt % synthetic fibers, and if natural fibers are present, they can be included at from 0.1 wt % to 80 wt % natural fibers. In some examples, the flame-retarding filler can include a mineral powder selected from the group consisting of aluminum hydroxide, magnesium hydroxide, huntite, hydromagnesite, hydrates, red phosphorus, boehmite, borates, and combinations thereof.

A method of preparing an embossed print medium is also disclosed and can include applying an image-receiving layer to a media substrate at a coating weight of from 3 gsm to 50 gsm, embossing an image-receiving layer on a media substrate to form an embossed image-receiving layer, and directly coupling the media substrate to a fabric liner via an adhesive layer. The image-receiving layer can include a first pigment filler and a first polymeric binder. The image-receiving layer can be embossed at an embossing depth from 5 μm to 150 μm. The adhesive layer can include a second polymeric binder and a flame-retarding filler. In one example, an applying an abrasion-resistant layer can also be applied at a coating weight of from 3 gsm to 50 gsm, and can include a cross-linked polymer network and a second pigment filler.

In certain examples, the embossed-image receiving layer can be applied at a coating weight of from 5 gsm to 30 gsm; the abrasion-resistant layer (if present) can be applied at a coating weight of from 5 gsm to 20 gsm; and/or the adhesive layer can be applied at a coating weight of from 20 gsm to 40 gsm. Furthermore, the fabric liner can have a weight ranging from 30 gsm to 90 gsm, for example.

In another example, a system is described that includes a frame having a front side and a back side and an embossed print medium positioned on the front side of the frame. A first tensioner and a second tensioner can each be coupled to the back side of the frame. Further, the first and second tensioners can be configured to apply an opposing tension to opposite ends of an embossed print medium to position the embossed print medium across the front side of the frame. The embossed print medium can have a first end attached to the frame at the first tensioner and a second end opposite the first end, the second end being attached to the frame at the second tensioner. In some examples, the first tensioner, the second tensioner, or both can include a tensioning roller. In some examples, the embossed print medium can be an embossed print medium prepared or formed according to examples described herein.

An embossed print medium according to the present disclosure can be created by a variety of embossing and un-embossing techniques. Such embossing and un-embossing techniques are the processes of creating either raised or recessed relief images and designs in paper and other materials. An embossed pattern is raised against the background, while an un-embossed pattern is sunken into the surface of the material. In some examples, the textured media is a media that has been embossed. Said embossed media is capable of retaining all of its inherent imaging and performance properties. The textured media can be obtained by embossing a pattern into a media via passing said media between rollers with a patterned surface.

A standard embossing machine for embossing an embossable media typically includes two (or more) rollers: an embossing roller and a backing roller. The embossing roller can be laser or acid engraved with a specific pattern that is designed by a graphic designer. The backing roller can have a rubber cover or paper/wool type backing. The print media can pass through the nip between the embossing roller and backing roller. The nip is often pressurized with a hydraulic system. After the embossing process, the print media surface will mimic the design pattern of an embossing roller. The depth of the embossed texture is dependent on a variety of factors such as paper surface property, embossing pressure, machine speed, and engraving depth and pattern.

The technique for embossing a texture, pattern and/or design onto a media can involve molding the surface of a media by forcing it between a pressure nip formed by embossing rollers. The textured printable media can also be obtained by using embossing cylinders that may be mechanically or chemically etched with a specific pattern and/or design. The textured media can be created using an embossing roller under pressure. The media is altered during texturing by creating embossed depths ranging from about 5 μm to about 150 μm or from about 5 μm to about 90 μm. In one specific example, embossing can produce a peak-valley differential average of about 50 μm. The Parker Print Surface (PPS) roughness for embossed printable media can vary from about 5 μm to about 15 μm at 1600 psi pressure on the embossing roll. The load and depth of pattern increases the surface roughness. The Confocal microscope Zygo surface roughness can increase from 0.2 μm Rq (rmsmic) to 11.5 μm Rq (rmsmic). The static coefficient of friction does not change but the kinetic coefficient of friction slightly decreases as the surface area is reduced. In some examples, the surface roughness of the printable media is greater than 5 μm per PPS method.

Generally, a suitable embossable print medium can include a substrate that is able to form a permanent textured surface under force, and optionally under heat, by contact of a mold with the surface of the substrate. A permanent textured surface can mean that the "bounce back" of the textured surface, or the degree of reversion of the textured surface back to an untextured surface, is substantially minimal. Substantially minimal can mean that the average "bounce back", or the average change in the peak to valley depth from the initial peak to valley depth is less than 20%. In another example, the average "bounce back" can be less than 10%. In another example, the average "bounce back" can be less than 5%.

In some examples, the media substrate can be a polymeric film, such as a polyurethane sheet, a polyvinyl chloride sheet, or other polymeric sheet. In other examples, the supporting substrate can be made from 100% natural wood fiber. 100% natural wood fiber can refer to a cellulose-based substrate (e.g., paper or board). In some examples, the cellulose-based substrate can include pulp and a filler. The pulp can be wood pulp (e.g., kraft chemical pulp, sulfite chemical pulp, groundwood pulp, thermomechanical pulp, and/or chemo-thermomechanical pulp), wood-free pulp, recycled fabric pulp, or combinations thereof. The filler can be clay, kaolin clay, calcined clay, ground calcium carbonate ($CaCO_3$), precipitated calcium carbonate, gypsum (i.e., hydrated calcium sulfate), silica, talc, zeolite, titanium oxide, or combinations thereof. In some examples, the cellulose-based substrate can include from about 5 wt % to about 35 wt % or about 10 wt % to about 30 wt % filler and a balance of pulp.

In another example, the cellulose-based substrate can also include other additives, such as sizing agents, alkenyl or alkylsuccinic acid anhydride emulsifying cation products and rosin derivatives, dry strengthening agents, wet strengthening agents, retention aids, flocculants, deinking agents, surfactants, fixers, pH adjustors, biocides, coloring agents, or combinations thereof. Any of these additives can be added to the media substrate or can be applied to surface(s) of the media substrate (using a surface treatment) in an amount ranging from about 0.1 gsm to about 25 gsm or about 0.5 gsm to about 10 gsm.

In some examples, a polymeric latex can be used to treat or saturate the media substrate. A polymeric latex can refer to polymer particulates dispersed in an aqueous solvent for application either to the bulk of the media substrate using wet end processing or to the surface using surface sizing processing. These polymers can be made from monomer(s) that are polymerized in a random, block, and/or grafting manner, and in some instances are cross-linked. One or more types of monomers can be polymerized or co-polymerized to form the polymer particulates. In one specific example, the polymer particulates can be homopolymers of methacrylic acid esters. In another example, the polymer particulates are copolymers of a methacrylic acid ester and any of an acrylic acid ester, styrene, or divinyl benzene. In some examples, monomers that can be used to form the polymer particulates can include methyl methacrylate, t-butylmethacrylate, methyl acrylate, ethyl (meth)acrylate, butyl (meth)acrylate, 2-ethylhexyl (meth)acrylate, benzyl (meth)acrylate, lauryl (meth)acrylate, oleyl (meth)acrylate, palmityl (meth)acrylate, stearyl (meth)acrylate, hydroxyethylacrylate, hydroxyethylmethacrylate, hydroxypropylacrylate, hydroxypropylmethacrylate, ethylene glycol di(meth)acrylate, allyl (meth) acrylate, 1,3-butane-diol di(meth)acrylate, diethylene glycol di(meth)acrylate, trimethylol propane trimethacrylate, or combinations thereof. In another example, an acrylate monomer without methyl substitution, such as ethyl acrylate instead of ethyl (methyl) acrylate can also be used. Further, vinyl ester monomers (e.g., vinyl acetate, vinyl propionate, vinylbenzoate, vinylpivalate, vinyl-2-ethylhexanoate, vinylversatate), vinyl benzene monomers, C1-C12 alkyl acrylamide and methacrylamide monomers (e.g., t-butyl acrylamide, sec-butyl acrylamide, N,N-dimethylacrylamide), olefin monomers (e.g., polyethylene, polypropylene, and co-polymers), and combinations thereof can also be used.

Where the media substrate is treated or saturated with a polymeric latex, the media substrate can include from about 3 wt % to about 20 wt % polymeric latex of cellulose base.

Further, the polymeric latex can be in the form of polymeric latex composition that can include a polymeric latex composition filler. The polymeric latex composition filler can refer to inorganic and organic particles with different shapes or crystalline structures, if they are presented in a specific crystal lattice. Non-limiting examples of inorganic particles can include: calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthetic amorphous silica, colloidal silica, colloidal alumina, pseudoboehmite, aluminum hydroxide, alumina, lithopone, zeolite, magnesium carbonate, magnesium hydroxide, and various combinations thereof. In another example, inorganic particles can be selected from the group consisting of silica, clay, kaolin, calcium carbonate, talc, titanium dioxide, zeolites, and combinations thereof. In another example, the polymeric latex composition fillers are inorganic pigment particles received in a dry-powder form or in a form of an aqueous suspension. The polymeric latex can be blended into the cellulose base during wet-end processing of paper making by mixing the polymeric latex into the pulp furnishing or alternatively, immersed into the surface of cellulose base during dry-end processing of paper-making by surface sizing latex into the substrate surface.

Thus, a variety of media substrates can be used with embossed print media described herein. To these or other media substrates that are capable of receiving and holding an embossed pattern, an image-receiving layer(s) can be applied. The function of the image-receiving layer(s) is to provide an acceptable surface so the ink can be deposited onto it and generate acceptable print quality. The image-receiving layer(s) can facilitate both image quality and image durability.

The image-receiving layer can be a single layer or multiple layers with the same or different coating compositions. The total coat weight of the image-receiving layer may fall within any suitable range. In some examples, the coating weight can depend on the degree of "bounce back" of the media substrate. Thus, where the media substrate has a strong ability to retain an embossed pattern, the coating weight can be light (i.e. from 2 gsm to 5 gsm). However, where the media substrate has a high "bounce back," a heavier coating weight can be used (i.e. from 10 to 50 gsm).

In one example, the dry coating weight can be from about 1 gsm to about 50 gsm. In another example, the dry coating weight can range from about 5 gsm to about 30 gsm. In another example, the dry coating weight can range from about 5 gsm to about 20 gsm. In another example, the dry coating weight can range from about 10 gsm to about 20 gsm. Application of the coating can be by any method known in the art, including Meyer rod applicator, knife coating applicator, curtain coating applicator, or the like. Once coated, the image-receiving composition dries to form the image-receiving layer. In some non-limiting examples, the thickness of the image-receiving layer can range from about 5 microns (μm) to about 40 μm.

Once the image-receiving layer is applied to the print medium, the surface of the print medium can be textured via an embossing process, as previously described. In one example, the print medium can be embossed at an embossing depth from 5 μm to 150 μm. In another example, the image-receiving layer can be embossed at an embossing depth from 5 μm to 120 μm. In another example, the image-receiving layer can be embossed at an embossing depth from 5 μm to 90 μm, at an embossing depth of 10 μm to 90 μm, or at an embossing depth of 25 μm to 90 μm.

In some examples, the image-receiving layer can include a first polymeric binder. Any suitable polymeric binder can be used. In one example, the polymeric binder can be an aqueous based polymeric binder. Examples of suitable polymeric binders include polyvinyl alcohol, styrene-butadiene emulsion, acrylonitrile-butadiene latex, and combinations thereof. Moreover, in addition to the above binders, other aqueous binders can be added including starch (including oxidized starch, cationized starch, esterified starch, enzymatically denatured starch, and so on), gelatin, casein, soybean protein, cellulose derivatives including carboxymethyl cellulose, hydroxyethyl cellulose and the like; acrylic emulsion, vinyl acetate emulsion, vinylidene chloride emulsion, polyester emulsion, and polyvinylpyrrolidone. Other examples of suitable polymeric binders include aqueous based binders such as polyvinyl alcohol (examples of which include Kuraray Poval®235, Mowiol®6-98, Mowiol®40-88, and Mowiol®20-98 available from Kuraray America, Inc.), styrene-butadiene emulsions, acrylonitrile-butadiene latex, and combinations thereof.

In some examples, the first polymeric binder can have a weight average molecular weight (Mw) greater than 10,000 Mw. In some examples, the first polymeric binder can have an Mw from 10,000 Mw to 200,000 Mw. In some examples, the first polymeric binder can have an Mw from 20,000 Mw to 100,000 Mw. In some cases, a higher molecular weight polymeric binder can form a stronger coating layer to help retain the embossed texture.

In one example, the amount of the polymeric binder present in the image-receiving layer can be from about 5 to about 100 parts per 100 parts of a first pigment filler by dry weight. In other examples, the amount of polymeric binder ranges from about 7 parts to about 50 parts per 100 parts of the first pigment filler by dry weight, or about 10 parts to about 40 parts per 100 parts of the first pigment filler by dry weight, or about 15 parts to about 40 parts per 100 parts of the first pigment filler by dry weight.

In another example, the image-receiving layer can be a "polymer-rich" composition. A "polymer-rich" composition, as described herein, refers to a composition where the weight percentage of the polymeric fraction in the composition is no less than 20% by weight. In another example, the polymeric fraction of the composition is no less than 40% by weight. A polymer rich composition can provide a printing media with excellent performance in the areas of ink durability and stain resistance.

Polymer-rich compositions can include a poly-alkene compound, such as a poly-alkene homopolymer, a poly-alkene copolymer, a modified poly-alkene, and combinations thereof. By definition, a "poly-alkene," as described herein, refers to a polymeric material formed via polymerization of an alkene monomer, i.e., $C_nH_{2n}$ and its derivatives, where n is within a range of about 7,000 to about 200,000. Some non-limiting examples of poly-alkenes that can be used include polyethylene homopolymer, polypropylene homopolymer, polytetrafluoroethylene (PTFE), polyamide, amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, and combinations thereof.

The polymer-rich composition can also include any polymer that shows a strong capability to make a laminating composition on the supporting media substrate, or on the surface of the next layer. Some examples of such polymers include, but are not limited to, polyvinyl alcohol (examples of which include Kuraray Poval®235, Mowiol®40-88, and Mowiol®20-98 available from Kuraray America, Inc.), styrene-butadiene emulsion, acrylonitrile-butadiene latex, and any combinations thereof. In addition to the above binders, other aqueous binders can be added including: starch (including oxidized starch, cationized starch, esterified starch, enzymatically denatured starch and so on), gelatin, casein, soybean protein, cellulose derivatives including carboxymethyl cellulose, hydroxyethyl cellulose and the like; acrylic emulsion, vinyl acetate emulsion, vinylidene chloride emulsion, polyester emulsion, and polyvinylpyrrolidone. In another example, the polymer-rich composition can include a cross-linkable polymer such as polyurethane, acrylic-urethane hybrid polymers, and epoxy based polymers.

The image-receiving layer can also include a latex film-forming agent. The latex film-forming agent of the image-receiving layer is provided to facilitate forming a film of a latex ink (i.e., an image) that may be subsequently deposited on the print medium as an image. The "latex film-forming agent" may be any kind of chemical agent having water compatibility and temperature volatility that is capable of lowering an elastic modulus of ink latex particulates and of providing temporary plasticization to promote polymer chain motion to enhance forming a latex ink film from latex ink particulates. Representative examples of latex film-forming agents include, but are not limited to, citrate or sebacate compounds, ethyoxy alcohols, glycol oligomers and other low molecular weight polymers, glycol ether, glycerol acetals, surfactants that are either anionic, cationic, or non-ionic and have a backbone of more than 12 carbons, cyclic amide-like lactams, e.g., β-lactam, γ-lactam, and δ-lactam, a combination of two or more thereof, or a mixture of two or more thereof. In some examples, the latex ink film-forming agent is a cyclic amide-like lactam such as β-lactam, γ-lactam, and δ-lactam, or a mixture thereof. In an example, the latex ink film-forming agent is a γ-lactam. Representative examples of a γ-lactam include, but are not limited to, N-methyl-2-pyrrolidone, 5-methyl-2-pyrrolidone, and 2-pyrrolidone.

A ratio of an amount of a first pigment filler to an amount of the film forming agent may be (by weight) at a range of about 200:1 to about 10:1. In some examples, the ratio of the amounts of the first pigment filler to the film forming agent is at a range of about 150:1 to about 10:1, or about 100:1 to about 10:1, or about 80:1 to about 10:1, or about 65:1 to about 10:1, or about 50:1 to about 10:1, or about 35:1 to about 10:1. In some examples, the ratio of the amounts of the first pigment filler to the film forming agent is at a range of about 200:1 to about 15:1, or about 200:1 to about 20:1, or about 200:1 to about 25:1, or about 200:1 to about 30:1, or about 200:1 to about 35:1, or about 200:1 to about 40:1. In other examples, the ratio of the amounts of the first pigment filler to the film forming agent can be at a range of about 100:1 to about 11:1, or about 50:1 to about 12:1, or about 35:1 to about 13:1, or about 30:1 to about 14:1.

The first pigment filler can include any suitable pigment filler or combination of pigment fillers. For example, the first pigment filler can include either inorganic and/or organic particulates. The first pigment filler can be in solid powder form or it can be dispersed in a slurry. Some non-limiting examples of inorganic pigment fillers include aluminum silicate, kaolin clay, a calcium carbonate, silica, alumina, boehmite, mica, talc, or combinations or mixtures thereof. The inorganic pigment filler can include clay or a clay mixture. The inorganic pigment filler can include a calcium carbonate or a calcium carbonate mixture. The calcium carbonate can be one or more of ground calcium carbonate (GCC), precipitated calcium carbonate (PCC), modified GCC, or modified PCC. The inorganic pigment fillers can also include a mixture of a calcium carbonate and clay. In some examples, the inorganic pigment fillers can include two different calcium carbonate pigments (e.g., GCC and PCC).

Examples of organic pigment filler include, but are not limited to, particles, either existing in a dispersed slurry or in a solid powder, of polystyrene and its copolymers, polymethacrylates and their copolymers, polyacrylates and their copolymers, polyolefins and their copolymers, and combinations thereof. In one example, the pigment filler can include polyethylene, polypropylene, and combinations thereof. Additionally, the pigment fillers can include silica gel (e.g., Silojet®703C available from Grace Co.), modified (e.g., surface modified, chemically modified, etc.) calcium carbonate (e.g., Omyajet®B6606, C3301, and 5010, all of which are available from Omya, Inc.), precipitated calcium carbonate (e.g., Jetcoat®30 available from Specialty Minerals, Inc.), or combinations thereof.

In one example, the first pigment filler can be present at a dry amount ranging from about 5 wt % to about 90 wt % of the total wt % of the image-receiving layer, or from 40 wt % to about 85 wt % of the total wt % of the image-receiving layer, or from 60 wt % to 80 wt % of the image-receiving layer.

In each of these cases, the first pigment filler can have a particle size ranging from 0.1 μm to 20 μm. In some examples, the first pigment filler can have a particle size ranging from 0.2 μm to 18 μm. In some examples, the first pigment filler can have a particle size ranging from 0.5 μm to 15 μm.

In some examples, the image-receiving layer can include a polymer blend of a water-dispersible and a water-soluble polymer at a weight ratio from 2:1 to 10:1.

Any suitable water-dispersible polymer can be used. Non-limiting examples can include styrene-butadiene emulsion, acrylonitrile-butadiene latex, acrylic emulsion, vinyl acetate emulsion, vinylidene chloride emulsion, polyester emulsion, polyurethane dispersion, acrylic-urethane hybrid polymer dispersions, epoxy based dispersed polymers, the like, and combinations thereof.

The water-soluble polymer can also include any suitable water-soluble polymer. Non-limiting examples can include polyvinyl alcohol (examples of which include Kuraray Poval®235, Mowiol®40-88, and Mowiol®20-98 available from Kuraray America, Inc.), polyvinylpyrrolidone, starch (including oxidized starch, cationized starch, esterified starch, enzymatically denatured starch and so on), gelatin, casein, soybean protein, cellulose derivatives including carboxy-methyl cellulose, hydroxyethyl cellulose, the like, and combinations thereof.

In one specific example, though material choices and ranges outside of the amounts given can be expanded as described herein, the image-receiving layer can include about 80 parts Hydrocarb® 60 (available from Omya NA), 20 parts Hydrocarb® 90 (available from Omya NA), 15 parts Acronal® 866 (available from BASF), 0.5 parts Byk-Dynwet® 800 (available from BYK, Inc.), and 0.5 parts BYK® 024 (available from BYK, Inc.). The final solids content after mixing can be from 25 wt % to 75 wt %, e.g., 52 wt %, and the viscosity can be from 120 to 250 centipoise (cps), e.g., 180 cps, as measured by a Brookfield viscometer at 100 rpm. The image-receiving layer can be applied to the media substrate samples at a coat weight of 3 gsm to 50 gsm, e.g., 20 gsm with a multi-structured coating.

While the image-receiving layer can provide an acceptable surface onto which the ink can be deposited to generate acceptable print quality, durability can still be an issue. Accordingly, after the image-receiving layer is applied to the print medium and the print medium is embossed, an abrasion-resistant layer can be applied to provide added durability to the embossed print medium. The abrasion-resistant coating can be applied at a coating weight of from 3 gsm to 50 gsm, or from 2 gsm to 20 gsm, or from 5 gsm to 15 gsm, or from 7 gsm to 15 gsm, or from 10 gsm to 15 gsm, or from 9 gsm to 20 gsm, or from 9 gsm to 15 gsm. In some examples a coating weight of at least 5 gsm can provide an abrasion-resistant layer having average to good durability, while maintaining good surface texture.

The abrasion-resistant layer can also be a "polymer-rich" layer. However, with respect to the abrasion-resistant layer, the weight percentage of polymers can be greater than 50 wt %, greater than 60 wt %, or, in some examples, greater than 85 wt %.

In some examples, the cross-linked polymer network includes a polyacrylate based polymer having a glass transition temperature (Tg) greater than 20° C., or, in some examples, greater than 50° C. In some examples, the polymer can be sufficiently reactive such that polymer chains self-cross-link with each other to form a cross linked polymer network. In some examples, both reactive and non-reactive varieties can be used.

In some examples, the cross-linked polymer network includes a hydrophilic polyurethane polymer (i.e. a water soluble or water dispersible polyurethane polymer). In some examples, polyurethane dispersions can be prepared with polyurethane prepolymers that are prepared with an NCO/OH equivalent ratio of from 1.2 to 2.2, or, in some examples, from 1.4 to 2.0, to form isocyanate-free compounds. The weight average molecular weight of polyurethane pre-polymers can range from 20,000 to 200,000 as measured by a gel permeation chromatography (GPC). Some examples of commercial water dispersible polyurethane that can be used are polyester based polyurethanes, U910, U938 U2101 and U420; polyether based polyurethane, U205, U410, U500 and U400N; polycarbonate based polyurethanes, U930, U933, U915 and U911, Castor oil based polyurethane, CUR21, CUR69, CUR99 and CUR991, all supplied by Alberdingk Inc.

In one example, the polyurethane can be cross-linked with a cross-linking agent. In one example, the polyurethane can be a self-cross-linking polyurethane. A self-cross-linking polyurethane can be formed by reacting an isocyanate with a polyol.

Suitable isocyanate groups used for preparing polyurethane resins can generally include toluenediisocyanate, 1,6-hexamethylenediisocyanate, diphenylmethanediisocyanate, 1,3-bis(isocyanatemethyl)cyclohexane, 1,4-cyclohexyldiisocyanate, p-phenylenediisocyanate, 2,2,4(2,4,4)-trimethylhexamethylenediisocyanate, 4,4'-dicychlohexylmethanediisocyanate, 3,3'-dimethyldiphenyl, 4,4'-diisocyanate, m-xylenediisocyanate, tetramethylxylenediisocyanate, 1,5-naphthalenediisocyanate, dimethyltriphenylmethanetetraisocyanate, triphenylmethanetriisocyanate, tris(isocyanatephenyl)thiophosphate, and combinations thereof.

In a more specific example, the isocyanate groups can be "protected" from water. This can be advantageous in aqueous solutions or dispersions because isocyanate groups can react with water to form carbamic acid and subsequently be converted into an amine. The reactant amine can further react with additional isocyanate groups to form urea. Thus, in one embodiment, "hydrophilic" polyisocyantes can be used to cross-link polyurethane. Some commercial examples of such isocyanurates can include Rhodocoat WT 2102, from Rhodia AG; Basonat LR 8878 from BASF, Desmodur DA and Bayhydur 3100 from Bayer.

In another example, blocked polyisocyanates can be used as the cross-linker. These isocyanates can be pre-blocked using polyalkylene oxide units and/or ionic groups, which can make the isocyantes "hydrophilic" and therefore dispersible in water. The blocking agents can release from the isocyantes when a deblocking temperature is reached, yielding free isocyanate groups that can react with active hydrogen atoms of the polyurethane polymer. One commercial example of a blocked water-dispersible polyisocyanates is BAYHYDUR VP LS 2306 from Bayer, which is based on dicyclohexylmethane diisocyanate.

Suitable polyols the for preparing polyurethane resins can include 1,4-butanediol, 1,3-propanediol, 1,2-ethanediol, 1,2-propanediol, 1,6-hexanediol, 2-methyl-1,3-propanediol, 2,2-dimethyl-1,3-propanediol or neopentyl glycol, cyclohexanedimethanol, 1,2,3-propanetriol, 2-ethyl-2-hydroxymethyl-1,3-propanediol.

In some examples, the isocyanates and polyols can have, on average, less than three end functional groups per molecule so that the polymeric network is based on a liner polymeric chain structure. In one example, the polyurethane chain can have a trimethyloxysiloxane group and the cross-linking action can take place via hydrolysis of the function group to form a silsesquioxane structure. The polyurethane chain can also have an acrylic functional group, and the cross-linked structure can be formed by nucleophilic addition to an acrylate group through acetoacetoxy functionality.

In some other examples, the polyurethane can be a vinyl-urethane hybrid polymer or an acrylic-urethane hybrid polymer. In yet some other examples, the polyurethane can be an aliphatic polyurethane-acrylic hybrid polymer.

In some examples, the polyurethane can include a modified or unmodified polymeric core of either polyurethane or a copolymer that includes polyurethane. Suitable polyurethanes can include aliphatic as well as aromatic polyurethanes. In a more specific example, the polyurethane can be a reaction product of the following components: a polyisocyanate having at least two isocyanate (—NCO) functionalities per molecule with, at least, one isocyanate-reactive group such as a polyol having at least two hydroxy groups or an amine. Suitable polyisocyanates include diisocyanate monomers, and oligomers.

In another example, the polyurethane can include an aromatic polyether polyurethane, an aliphatic polyether polyurethane, an aromatic polyester polyurethane, an aliphatic polyester polyurethane, an aromatic polycaprolactam polyurethane, an aliphatic polycaprolactam polyurethane, or a combination thereof. In a more specific example, the polyurethane can include an aromatic polyether polyurethane, an aliphatic polyether polyurethane, an aromatic polyester polyurethane, an aliphatic polyester polyurethane, and a combination thereof.

Some non-limiting, representative commercially-available examples of suitable polyurethanes can include NeoPac®R-9000, R-9699, and R-9030 (from Zeneca Resins), Printrite®DP376 and Sancure®AU4010 (from Lubrizol), and Hybridur®570 (from Air Products). Other examples can include Sancure®2710 and/or Avalure®UR445 (which are equivalent copolymers of polypropylene glycol, isophorone diisocyanate, and 2,2-dimethylolpropionic acid, having the International Nomenclature Cosmetic Ingredient name "PPG-17/PPG-34/IPDI/DMPA Copolymer"), Sancure®878, Sancure®815, Sancure®1301, Sancure®2715, Sancure®2026, Sancure®1818, Sancure®853, Sancure®830, Sancure®825, Sancure®776, Sancure®850, Sancure®12140, Sancure®12619, Sancure®835, Sancure®843, Sancure®898, Sancure®899, Sancure®1511, Sancure®1514, Sancure®1517®, Sancure®1591, Sancure®2255, Sancure®2260, Sancure®2310, Sancure®2725, and Sancure®12471 (all commercially available from Lubrizol Inc.).

In some examples, the cross-linked polymer network can include an epoxy. The epoxy can include alkyl and aromatic epoxy resins or epoxy-functional resins, such as for example, epoxy novolac resin(s) and other epoxy resin derivatives. Epoxy-functional resins can include at least one, or two, or more pendant epoxy moieties. The molecules can be aliphatic, aromatic, linear, branched, cyclic, or acyclic. If cyclic structures are present, they may be linked to other cyclic structures by single bonds, linking moieties, bridge structures, pyro moieties, and the like. Some non-limiting examples of suitable epoxy functional resins are commercially available and include, without limitation, Ancarez®AR555 (commercially available from Air Products), Ancarez®AR550, Epi-rez®3510W60, Epi-rez®3515W6, or Epi-rez®3522W60 (commercially available from Hexion).

In some examples, the epoxy can include an aqueous dispersion of an epoxy resin. Some non-limiting examples of commercially available aqueous dispersions of epoxy resins include Araldite®PZ3901, Araldite®PZ3921, Araldite®PZ3961-1, Araldite®PZ323 (commercially available from Huntsman), Waterpoxy®1422 (commercially available from Cognis) or Ancarez®AR555 1422 (commercially available from Air Products).

In some examples, the epoxy can be self-cross-linked. In some examples, the epoxy can be cross-linked via epoxy resin hardeners. Some non-limiting examples of epoxy resin hardeners include liquid aliphatic or cycloaliphatic amine hardeners of various molecular weights, in 100% solids or in emulsion or water and solvent solution forms. Amine adducts with alcohols and phenols or emulsifiers can also be envisioned. Examples of suitable commercially available hardeners include Anquawhite®100 (from Air Products), Aradur®3985 (from Huntsman), and EPI-CURE® 8290-Y-60 (from Hexion). The second polymeric network can include a water-based polyamine as an epoxy resin hardener. Such epoxy resin hardeners can be, for examples, water-based polyfunctional amines, acids, acid anhydrides, phenols, alcohols and/or thiols.

In some other examples, the epoxy can include a polyglycidyl or a polyoxirane resin. These epoxies can also be self-cross-linked (through catalytic homopolymerisation of oxirane function group) or they can be cross-linked with the help of a wide range of co-reactants including polyfunctional amines, acids, acid anhydrides, phenols, alcohols, and thiols.

In a more specific example, the cross-linked polymer network can include a water-based epoxy resin and water-based polyamine as an epoxy resin hardener. In another more specific example, the cross-linked polymer network can include a polyurethane and a polyglycidyl or polyoxirane resin. In yet another more specific example, the cross-linked polymer network can include a vinyl-urethane hybrid polymer or acrylic-urethane hybrid polymer and a water-based epoxy resin, including a water-based polyamine as an epoxy resin hardener.

In another example, the cross-linked polymer network can include styrene maleic anhydride (SMA) compounds. The use of styrene maleic anhydride (SMA), particularly higher molecular weight variants, such as Novacote 2000 from Georgia-Pacific, can form high gloss and very smooth layers. The gloss of these layers can be as high as 50 when measured at a 20 degree angle with a gloss meter from Byk-Gardner. However, SMA alone can be a very brittle compound that is prone to cracking when the article upon which it is coated is flexed or bent. One way to overcome the brittleness of the SMA while still retaining the high gloss properties is to combine SMA with an amine terminated polyethylene oxide (PEO), polypropylene oxide (PPO), a copolymer thereof, a or combination thereof. This combination can strengthen the SMA by crosslinking it via its acid carboxylate functionality with the amine moieties of the amine terminated PEO/PPO compounds. The amine functionalization can include amine termination at both ends of a PEO/PPO chain or functionalization of side chains of a branched PEO/PPO. The PEO/PPO segment of the cross-linked polymer film can eliminate the brittle nature of the lone SMA while retaining the high gloss features. Some commercial examples of amine terminated PEO/PPO compounds include but are not limited to: Jeffamine XTJ-500, Jeffamine XTJ-502 and XTJ D-2000 all from Huntsman. The blend of SMA to amine terminated PEO/PPO can have a weight ratio from 100:1 to about 2.5:1. In some cases, larger weight ratios can be ineffective at adequately eliminating cracking of the SMA. In some cases, lower ratios can result in a tacky composition that is not suitable to be fed through a printer.

The abrasion-resistant layer can also include a second pigment filler. Any pigment filler that can be used for the first pigment filler can also be used for the second pigment filler. The second pigment filler is typically present in the abrasion-resistant layer in an amount from about 5 wt % to about 90 wt % of the total wt % of the abrasion-resistant layer, or from about 40 wt % to about 85 wt % of the total wt % of the abrasion-resistant layer, or from about 60 wt % to about 80 wt % of the abrasion-resistant layer.

In further detail regarding the abrasion-resistant layer, as mentioned, this layer can also include a wax. The wax can typically be a synthetic or petroleum wax. However, other waxes can be used, such as vegetable waxes, animal waxes, mineral waxes, and the like. In one specific example, the wax can be a paraffin wax, a microcrystalline wax, a polyethylene wax, the like, or a combination thereof. In another specific example, the wax can be a high-melt wax, such as a high-melt polyethylene wax. A high-melt wax can be a wax that begins to soften at temperatures of at least 130° C. Some examples of commercially available waxes can include Slip-Ayd®SL100, Slip-Ayd®SL177, Slip-Ayd®SL18, Slip-Ayd®SL404, Slip-Ayd®SL417, Slip-Ayd®SL425, Slip-Ayd®SL4709, Slip-Ayd®SL506, Slip-Ayd®SL508, Slip-Ayd®SL50, Slip-Ayd®SL523, Slip-Ayd®SL530, Slip-Ayd®SL551, Slip-Ayd®SL555, Slip-Ayd®SL600, Slip-Ayd®SL620, Slip-Ayd®SL700, Slip-Ayd®SL78, and Slip-Ayd®SL94 (available from Elementis Specialties), and Acculin™400, Acculin™500, Acculin™600, Acculin™655, Acculin™725, Acculin™850, Acculin™1000, and Acculin™2000 (available from The International Group).

The wax can be present in the abrasion-resistant layer in an amount from about 1 wt % to 20 wt % in one example. In another example, the wax can be present in an amount from about 3 wt % to 20 wt %, or about 5 wt % to about 15 wt %. In another example, the wax can be present in an amount from about 7 wt % to about 15 wt %.

In some other examples, the abrasion-resistant layer can also contain a polymeric binder to provide good adhesion between the abrasion-resistant layer and image-receiving layer, if desired. The polymeric binder can be any suitable binder, including non-ionic polymers, cationic charged polymers, or any other suitable binder or mixtures thereof. Examples of suitable polymeric binders include polyvinyl alcohol (examples of which include Kuraray Poval®235, Mowiol®40-88, and Mowiol®20-98 available from Kuraray America, Inc.), styrene-butadiene emulsion, acrylonitrile-butadiene latex, or any combinations. Moreover, in addition to the above binders, other aqueous binders can be added including: starch (including oxidized starch, cationized starch, esterified starch, enzymatically denatured starch and so on), gelatin, casein, soybean protein, cellulose derivatives including carboxy-methyl cellulose, hydroxyethyl cellulose and the like; acrylic emulsion, vinyl acetate emulsion, vinylidene chloride emulsion, polyester emulsion, and polyvinylpyrrolidone. However, the polymeric binder will typically include a water-dispersible polymer rather than a water-soluble polymer. The amount of the polymeric binder can represent from about 5 to about 40 parts per 100 parts of the second pigment filler by dry weight; or can represent from about 10 to about 30 parts per 100 parts of the second pigment filler by dry weight.

The abrasion-resistant layer can further include a film-forming agent. It is to be understood that the "film-forming agent" may be capable of lowering the elastic modulus of polymer particulates (specifically found in latex inks to be printed on the printable medium) and providing temporary plasticization, which promotes polymer chain motion of the polymer particulates during the film forming process. Thus, the "film-forming agent" does not form a film per se, but rather, assists in the polymers present in forming a desirable film. Thus, the polymer particulates that are present are more readily able to coalesce, and therefore the film-forming agent can improve the film-forming properties of polymer particulates. In some examples, the film forming agent can include citrate compounds, sebacate compounds, ethoxy alcohols, glycol oligomers, glycol polymers, glycol ether, glycerol acetals, anionic, cationic or non-ionic surfactants having a backbone of 12 carbons or more (e.g., propylene glycol monoester of C-18 fatty acids and propylene glycol mono oleate (each of which is commercially available under the trade name Loxanol® by BASF Corp), cyclic amides, and combinations thereof. The cyclic amides may be β-lactams (e.g., clavam, oxacephem, cephem, penam, carbapenam, and monobactam), γ-lactams, δ-lactams (e.g., caprolactam and glucarolactam), and combinations thereof. In one specific example, the film-forming agent can be a γ-lactam. Representative examples of a γ-lactam include N-methyl-2-pyrrolidone, 5-methyl-2-pyrrolidone, and 2-pyrrolidone. In one specific example, the film-forming agent can be a surfactant. In a further example, the surfactant can be a non-ionic surfactant or combination of non-ionic surfactants.

The film-forming agent can be present in the abrasion-resistant layer in an amount from about 1 wt % to about 15 wt %. In another example, the film-forming agent is present in an amount from about 2 wt % to about 10 wt %. In another example, the film-forming agent is present in an amount from about 3 wt % to about 8 wt %.

In one specific example, the abrasion-resistant layer can include from about 5 wt % to about 40 wt % of a polyurethane, from about 5 wt % to about 30 wt % of an epoxy, from about 5 wt % to about 30 wt % of an epoxy resin hardener or curing agent, from about 3 wt % to about 20 wt % of a wax, from about 10 wt % to about 40 wt % of a second pigment filler, and from about 2 wt % to about 15 wt % of a film-forming agent. In another specific example, the abrasion-resistant layer can include about 80 parts Hydrocarb® 60 (available from Omya NA), 20 parts Hydrocarb® 90 (available from Omya NA), 15 parts Acronal® 866 (available from BASF), 1 part Byk-Dynwet® 800 (available from BYK, Inc.), 0.5 parts BYK® 024 (available from BYK, Inc.), 8 parts Royene® 4040 (available from Mallard Creek Polymers), 2.5 parts Araldite® PZ 3901 (available from Huntsman, Inc.), and 2.5 parts Aradur® 3985 (available from Huntsman, Inc.).

Application of the abrasion-resistant layer to the embossed image-receiving layer can from a suitable and durable printing surface on the top of the embossed print medium. However, to provide additional mechanical strength and a more traditional canvas look and feel to the embossed print medium, a fabric liner can be applied to a bottom side of the embossed print medium.

Generally, the fabric liner can include any textile, fabric material, fabric clothing, or other fabric structure. The term "fabric" can be used to mean a textile, a cloth, a fabric material, fabric clothing, or another fabric product. The term "fabric structure" is intended to mean a structure having warp and weft that is woven, non-woven, knitted, tufted, crocheted, knotted, and/or pressured, for example. The terms "warp" and "weft" refer to weaving terms that have their ordinary means in the textile arts, as used herein, e.g., warp refers to lengthwise or longitudinal yarns on a loom, while weft refers to crosswise or transverse yarns on a loom.

Additionally, fabric liners useful in the present disclosure can include fabric substrates that have fibers that can be natural and/or synthetic. It is notable that the term "fabric substrate" does not include materials commonly known as any kind of paper (even though paper can include multiple types of natural and synthetic fibers or mixture of both types of fibers). Furthermore, fabric substrates include both textiles in its filament form, in the form of fabric material, or even in the form of fabric that has been crafted into finished article (clothing, blankets, tablecloths, napkins, bedding material, curtains, carpet, shoes, etc.). In some examples, the fabric liner has a woven, knitted, non-woven, or tufted fabric structure.

The fabric liner can be a woven fabric where warp yarns and weft yarns are mutually positioned at an angle of about 90°. This woven fabric can include, but is not limited to, fabric with a plain weave structure, fabric with a twill weave structure where the twill weave produces diagonal lines on a face of the fabric, or a satin weave. The fabric liner can be a knitted fabric with a loop structure including one or both of warp-knit fabric and weft-knit fabric. The weft-knit fabric refers to loops of one row of fabric are formed from the same yarn. The warp-knit fabric refers to every loop in the fabric structure that is formed from a separate yarn mainly introduced in a longitudinal fabric direction. The fabric liner can also be a non-woven product, for example a flexible fabric that includes a plurality of fibers or filaments that are bonded together and/or interlocked together by a chemical treatment process (e.g., a solvent treatment), a mechanical treatment process (e.g., embossing), a thermal treatment process, or a combination of two or more of these processes.

The fabric liner can include one or both of natural fibers and synthetic fibers. Natural fibers that can be used include, but are not limited to, wool, cotton, silk, linen, jute, flax or hemp. Additional fibers that can be used include, but are not limited to, rayon fibers, or those of thermoplastic aliphatic polymeric fibers derived from renewable resources, including, but not limited to, corn starch, tapioca products, or sugarcanes. These additional fibers can be referred to as "natural" fibers. In some examples, the fibers used in the fabric liner includes a combination of two or more from the above-listed natural fibers, a combination of any of the above-listed natural fibers with another natural fiber or with synthetic fiber, a mixture of two or more from the above-listed natural fibers, or a mixture of any thereof with another natural fiber or with synthetic fiber.

Synthetic fibers that can be used in the fabric liner can include polymeric fibers such as, but not limited to, polyvinyl chloride (PVC) fibers, polyvinyl chloride (PVC)-free fibers made of polyester, polyamide, polyimide, polyacrylic, polypropylene, polyethylene, polyurethane, polystyrene, polyaramid, e.g., Kevlar®, polytetrafluoroethylene, e.g., Teflon® (both trademarks of E. I. du Pont de Nemours and Company), fiberglass, polytrimethylene, polycarbonate, polyester terephthalate, or polybutylene terephthalate. In some examples, the fiber used in the fabric liner can include a combination of two or more fiber materials, a combination of a synthetic fiber with another synthetic fiber or natural fiber, a mixture of two or more synthetic fibers, or a mixture of synthetic fibers with another synthetic or natural fiber. In some examples, the synthetic fiber can include a modified fiber. The term 'modified fiber' can refer to one or both of the synthetic fiber and the fabric liner as a whole having undergone a chemical or physical process such as, but not limited to, one or more of a copolymerization with monomers of other polymers, a chemical grafting reaction to contact a chemical functional group with one or both the synthetic fiber and a surface of the fabric, a plasma treatment, a solvent treatment, for example acid etching, and a biological treatment, for example an enzyme treatment or antimicrobial treatment to prevent biological degradation. The term "PVC-free" means no polyvinyl chloride (PVC) polymer or vinyl chloride monomer units in the substrate. In some examples, the fabric base substrate is a synthetic polyester fiber.

The fabric liner can include both natural fibers and synthetic fibers. In some examples, the amount of synthetic fibers represents from about 20 wt % to about 90 wt % of the total amount of fibers. In some other examples, the amount of natural fibers represents from about 10 wt % to about 80 wt % of the total amount of fibers. In some other examples, the fabric liner includes natural fibers and synthetic fibers in a woven structure, the amount of natural fibers is about 10 wt % of a total fiber amount and the amount of synthetic fibers is about 90 wt % of the total fiber amount. In some examples, the fabric liner can also include additives such as, but not limited to, one or more of colorant (e.g., pigments, dyes, tints), antistatic agents, brightening agents, nucleating agents, antioxidants, UV stabilizers, fillers, lubricants, and combinations thereof.

The fabric liner can be adhered to the bottom side of the embossed print media using an adhesive layer. The adhesive layer can include a second polymeric binder. The second polymeric binder can include any of those polymeric binders described with respect to the first polymeric binder. The second polymeric binder can be present in the adhesive layer in an amount from about 2 wt % to about 40 wt %, about 5 wt % to about 30 wt %, or from about 10 wt % to about 20 wt %.

The adhesive layer can also include a third pigment filler, and can include any of those pigment fillers or combinations thereof described above with respect to the first and second pigment fillers. The third pigment filler can be present in the adhesive layer in an amount from about 40 wt % to about 90 wt %, about 50 wt % to about 80 wt %, or from about 60 wt % to about 80 wt %.

The adhesive layer can also include a flame-retarding filler (i.e. a substance that shows flame retardance). The flame-retarding filler can include any substance that inhibits or reduces flammability or that delays the combustion of the medium containing it. Some non-limiting examples of flame-retarding fillers can include phosphorus-containing compounds, nitrogen-containing compounds, and organophosphate compounds. Phosphorus-containing compounds encompass organic and inorganic phosphates, phosphonates, and/or phosphinates with different oxidation states. Nitrogen-containing compounds that can likewise be used include melamines (including melamine derivatives) such as melamine, melamine cyanurate, melamine polyphosphate, melem, and melon.

Compounds having a molecular structure that includes both metal element and phosphorus also show acceptable flame retarding properties. Examples of such compounds can include aluminum diethylphosphinate, calcium diethylphosphinate, and combinations thereof. Flame-retarding fillers that contain both phosphorus and a halogen can have less of an adverse environmental. Such compounds can include tris(2,3-dibromopropyl) phosphate and chlorinated organophosphates such as tris(1,3-dichloro-2-propyl)phosphate (TDCPP), tetrekis(2-chlorethyl) dichloro-isopentyl-diphosphate, tris (1,3-dichloroisopropyl) phosphate, tris (2-chloroisopropyl) phosphate, tris (2-chloroisopropyl) phosphate. The flame-retarding filler can be also selected from mineral powders such as aluminum hydroxide (ATH), magnesium hydroxide, huntite and hydromagnesite hydrates, red phosphorus, boehmite (aluminum oxide hydroxide) and boron compounds, like borates. The flame-retarding filler can also include combinations of different flame-retarding fillers, including any of those listed herein.

The flame-retarding filler can be present in the adhesive layer in an amount from about 5 wt % to about 50 wt %, about 10 wt % to about 40 wt %, or about 20 wt % to about 40 wt %.

As one specific example, the adhesive layer can include about 60 parts Hydrocarb® 60 (available from Omya NA), 10 parts Hydrocarb® 90 (available from Omya NA), 15 parts Acronal® 866 (available from BASF), and 30 parts SpaceRite® S-3 (available from J.M. Huber Corp.).

Accordingly, the present disclosure illustrates an embossed print medium having an image-receiving layer(s) and abrasion-resistant layer(s) applied to the media substrate that provide a resilient printing surface for embossed media. Further, a fabric liner can be adhered to the media substrate to give the embossed print media a more real canvas look and feel.

In some embodiments, a system is provided for framing and/or displaying an embossed print medium. The system can include a frame and an embossed print medium.

The design of the frame can include left and right framing members each coupled to top and bottom framing members to form a square- or rectangular-shaped frame. The frame can also have a front side and a back side opposite the front side. A first tensioner and a second tensioner can be coupled to the back side of the frame. The first and second tensioners can be configured to apply an opposing tension to opposite ends of an embossed print medium to position the embossed print medium across the front side of the frame.

A variety of tensioners can be used with the frame described herein. Such tensioners can include springs, elastomeric bands or cords, rollers, the like, and combinations thereof. In one specific example, one or both of the first and second tensioner can include a tensioning roller. Any suitable anchoring mechanism can be used to anchor the tensioning roller at a given position, such as a securing pin, a ratchet mechanism, a friction-based anchoring mechanism, and the like.

The tensioners, such as the tensioning rollers, can be used to attach an embossed print medium to the frame. For example, the embossed print medium can be positioned on the front side of the frame and a first end of the embossed print medium can be attached to the frame at the first tensioner while a second end of the embossed print medium opposite the first end can be attached to the frame at the second tensioner. Thus, the opposing tension of the first and second tensioners can flatten, and in some cases even stretch, the embossed print medium across the front side of the frame. Further, the tensioners can facilitate adjustment of the embossed print medium for favorable display on the frame, either alone or in connection with one or more adjacent frames.

A variety of embossed print media can be used with the present system, such as printed wall paper, canvas media, or the like. In one example, the embossed print medium used with the system can be an embossed print medium as described herein. In one example, the embossed print medium can be a stretchable print medium.

The embossed print medium can be attached to the tensioners in a variety of ways. In some examples, the embossed print medium can be attached to the tensioners using clips, clamps, pins, screws, hook and loop fasteners, adhesive, friction-fitting, tieing, the like, and combinations thereof. In one specific example, adhesive can be used to attach the embossed print medium to one or both of the tensioners. In another example, the back of the left and right framing members can have a groove along the left and right margin. An adhesive with a protective liner can be placed on these grooves to respectively adhere the left and right edges of the embossed print medium the back of the frame along the left and right framing members.

Due the nature of many embossed print media (vinyl, woven, non-woven, etc), the embossed print medium can deforms (shrink or enlarge) after printing with printers that use heated dryers or that use inks that need curing. Depending on the robustness or dimensional stability of the media, there can be a panel to panel length difference. This can be magnified if long panels (i.e. 96 inches long) are printed. Thus, where multiple panels are to be displayed together, there can be a small offset or misalignment between the various panels. Accordingly, the tensioners of the present frame design can be used to align the plurality of images to provide a more uniform alignment between the various printed images. In some examples, the tensioners can be used to apply adequate tension to stretch the attached embossed print medium so that it aligns with an adjacent panel.

In one specific example, the embossed print medium can be attached to the frame in the following manner. Lay the assembled frame onto the back of the embossed print medium. Center the panel and attach the upper and lower ends of the panels to the top and bottom tensioning rollers, respectively, using regular tape. Using a Hex (Allen) key, tension the panel by turning the top tensioning roller clockwise and the bottom tensioning roller counter clockwise. A roller ratchet, pawl, and clip assembly can be used to prevent the roller from unwinding. Continue rotating the tensioning rollers until sufficient tension has been achieved. Remove a protective adhesive liner from the back of the frame to expose an adhesive film along the back side of the frame along the right and left framing members. Fold over the left and right margins of the embossed print medium and adhere them to the back of the frame via the adhesive film. If the embossed print medium is misaligned, use a Hex (Allen) key to tighten (or loosen) the tensioning rollers to adjust the alignment.

Accordingly, the present system can be used to frame and display a variety of embossed print media, including the embossed print media described herein.

Turning now to the figures, FIG. 1 shows an example of an embossed print medium 100. The media substrate 110 has been coated with an image-receiving layer 120. As can be seen from FIG. 1, the image-receiving layer has been embossed to provide the embossed print medium with a textured surface. However, the embossed print medium 100 does not include an abrasion-resistant layer. Additionally, a fabric liner 150 is adhered to the bottom side of the media substrate 110 via an adhesive layer 140. The fabric liner can provide a more traditional or real canvas look and feel to the embossed print medium.

Figure 2:
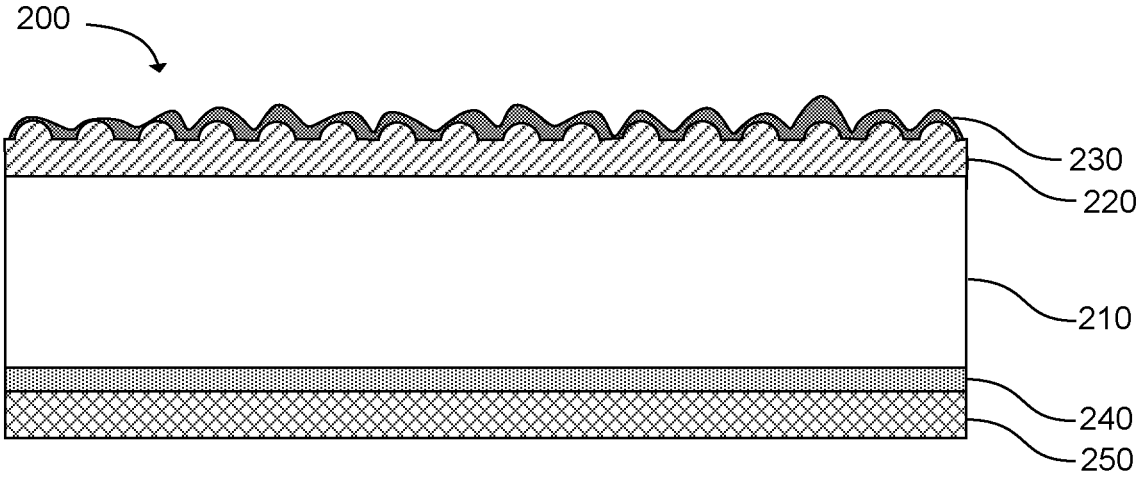
FIG. 2 is a cross-sectional view of an embossed print medium as shown in FIG. 1, but which includes an abrasion-resistant layer, in accordance with examples of the present disclosure.

FIG. 2 shows an example of an embossed print medium 200 that includes a media substrate 210, an embossed image-receiving layer 220, and an abrasion-resistant layer 230. Additionally, a fabric liner 250 is adhered to the bottom side of the media substrate 210 via an adhesive layer 240. The fabric liner can provide a more traditional or real canvas look and feel to the embossed print medium.

Figure 3:
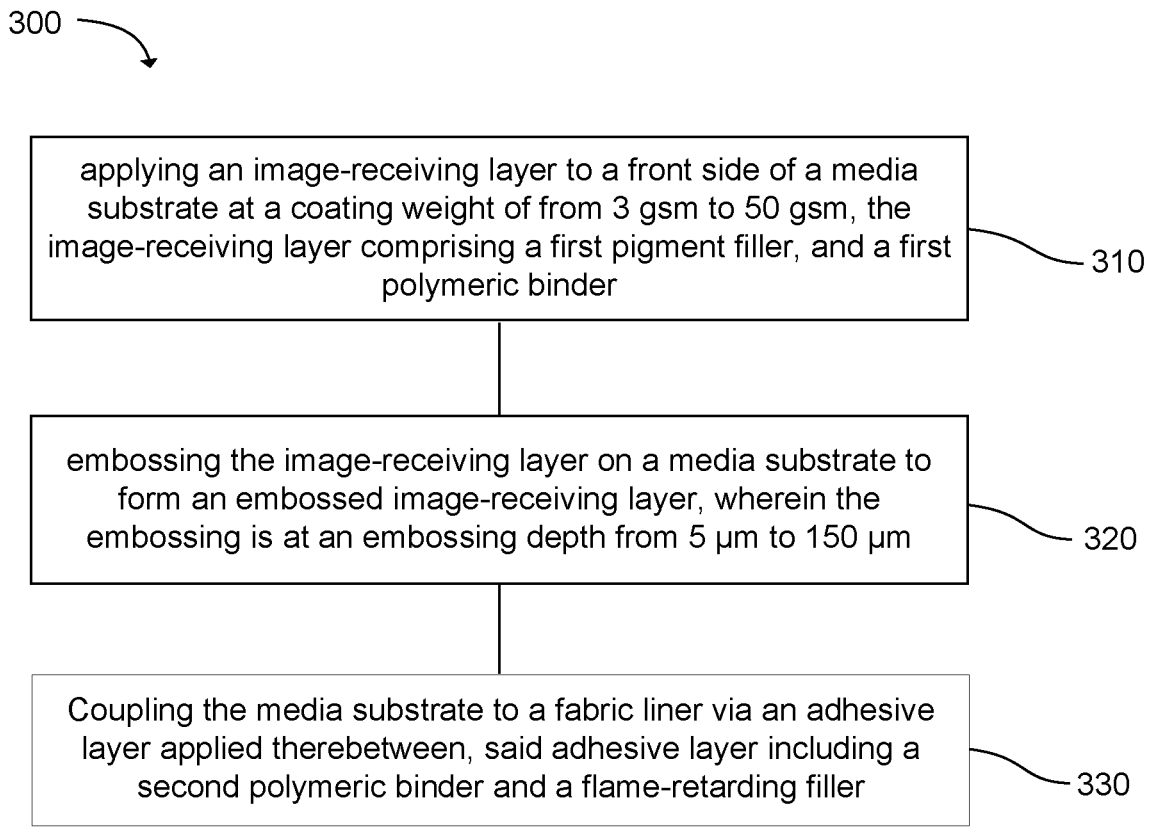
FIG. 3 illustrates a method of preparing an embossed print medium in accordance with examples of the present disclosure.

FIG. 3 depicts a method 300 of preparing an embossed print medium. The method includes various steps, which may or may not follow any particular order. One step can include applying 310 an image-receiving layer to a media substrate at a coating weight of from 3 gsm to 50 gsm, the image-receiving layer including a first pigment filler and a first polymeric binder. Another step can include embossing 320 the image-receiving layer on a media substrate to form an embossed image-receiving layer, wherein the embossing is at an embossing depth from 5 μm to 150 μm. An additional step can include coupling 330 the media substrate to a fabric liner via an adhesive layer applied therebetween, said adhesive layer including a second polymeric binder and a flame-retarding filler.

Figure 4:
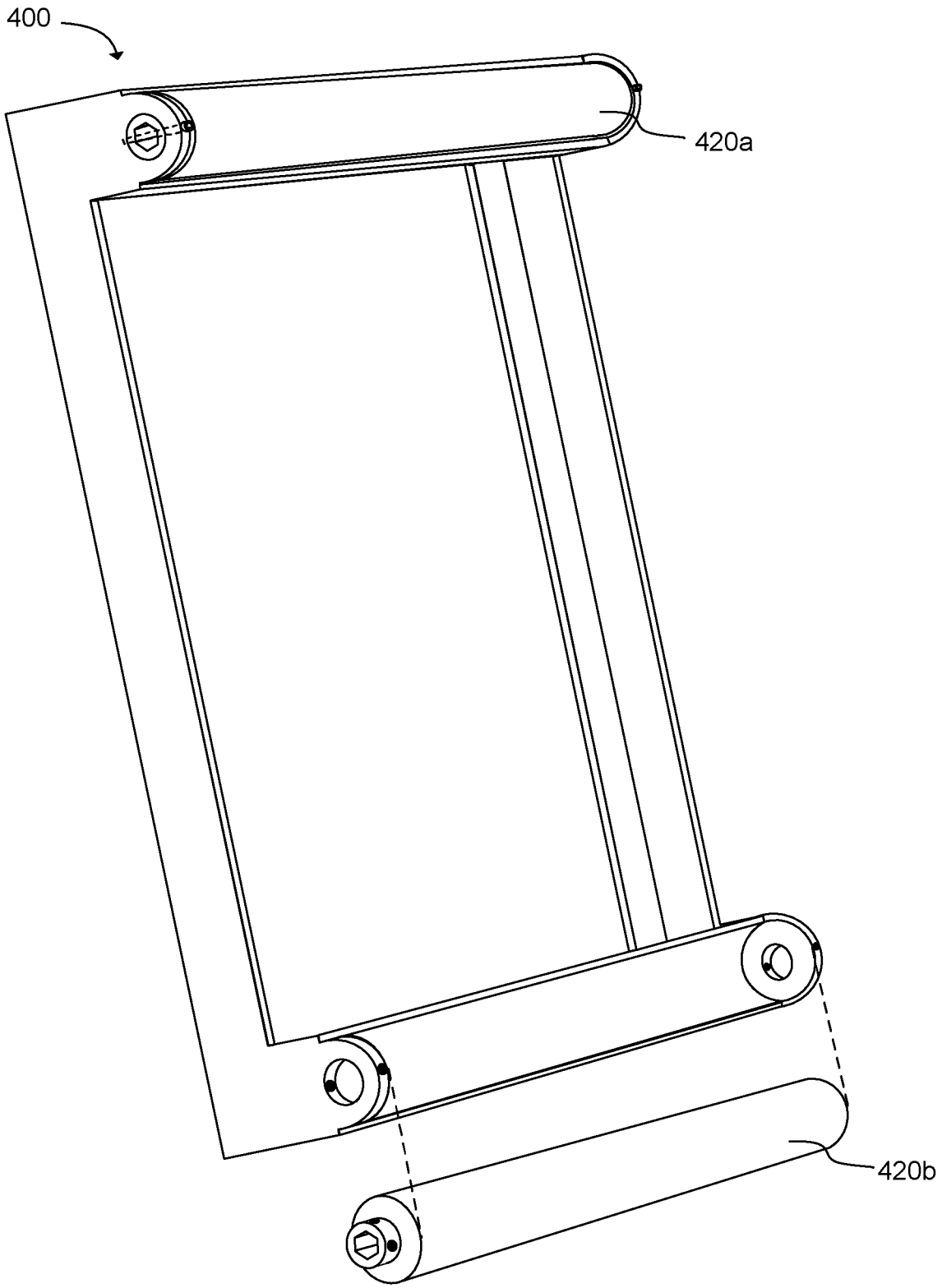
FIG. 4 illustrates the back side of a frame for an embossed print medium in accordance with examples of the present disclosure.

FIG. 4 illustrates a non-limiting example of a back side of a frame 400 in accordance with the present disclosure. The frame can have a first tensioning roller 420*a* and a second tensioning roller 420*b* coupled to the back side of the frame to apply an opposing tension to opposite ends of an embossed print medium. For example, opposite edges of an embossed print medium can be attached to the respective rollers by an adhesive, and then the tensioning rollers can be used to stretch the embossed print medium so that the medium is tight, and in many cases stretched up to 5% or more.

Figure 5:
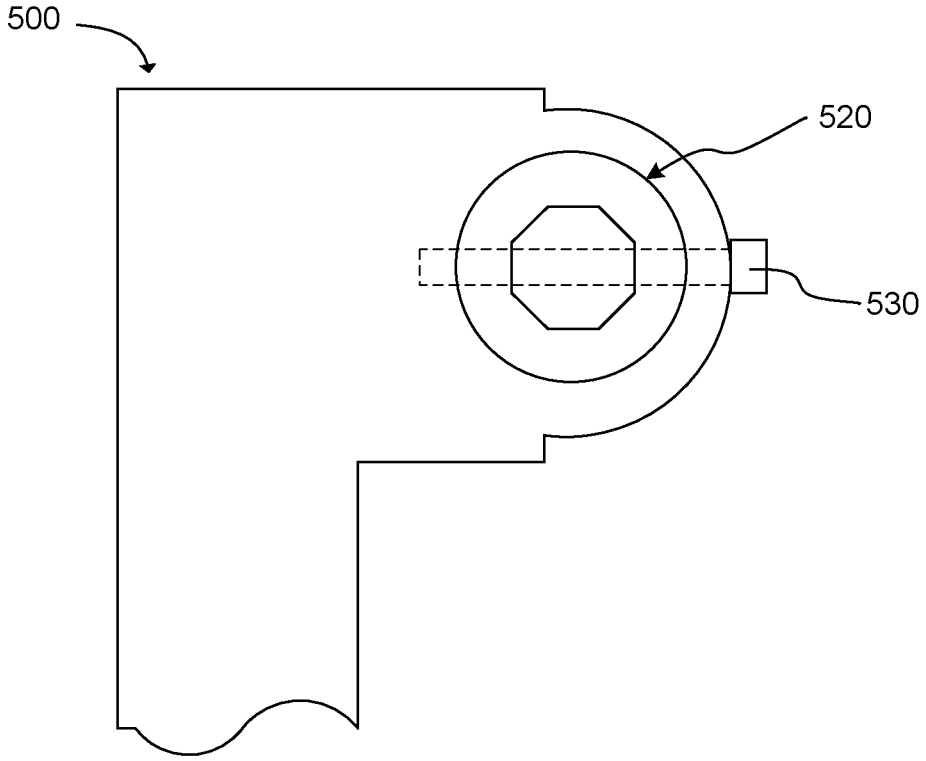
FIG. 5 illustrates one example of an anchoring mechanism for anchoring a tension roller at a desired position in accordance with examples of the present disclosure.

FIG. 5 depicts a side view of an upper portion of a frame 500. The tensioning roller 520 can be secured, once used to stretch the embossed print medium, with respect to frame 500 using a securing pin 530 as an anchoring mechanism. The securing pin can extend through portions of the frame and through the end of the tensioning roller to anchor or lock the tensioning roller 520 at a desired or specific location.

Figure 6:
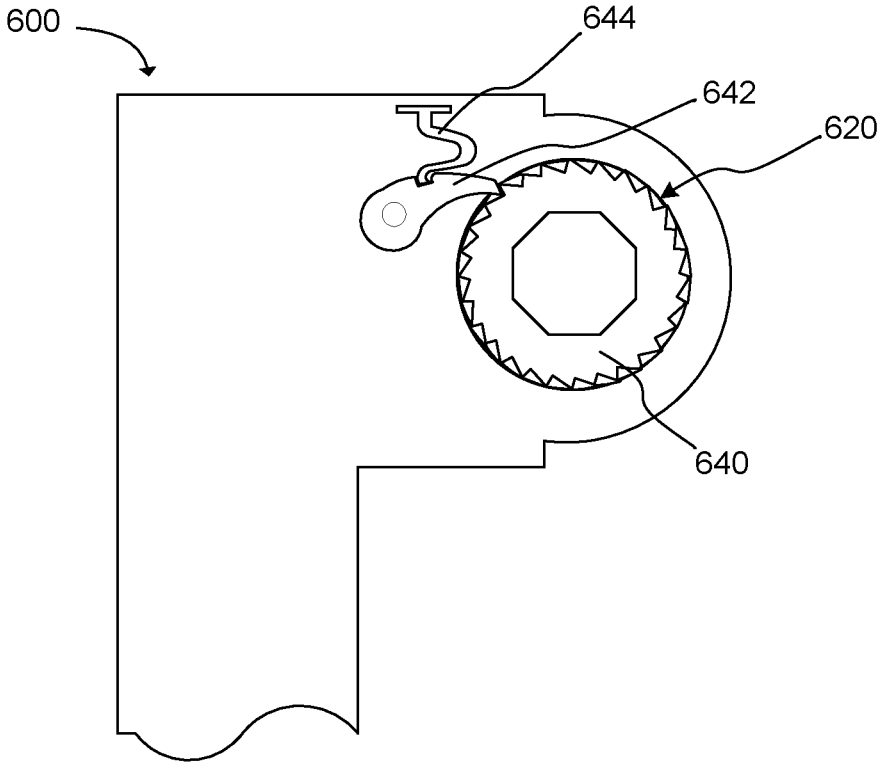
FIG. 6 illustrates another example of an anchoring mechanism for anchoring a tension roller at a desired position in accordance with examples of the present disclosure.

FIG. 6 depicts a side view of an upper portion of a frame 600. The frame 600 also has a tensioning roller 620, but in this example, the anchoring mechanism includes a ratchet 640 device. As the tensioning roller is rotated in manner to stretch the embossed print medium, the pawl 642 and clip/spring 644 system engages the ratchet to prevent the tensioning roller from slipping backwards. Other anchoring mechanisms can likewise be used.

It is noted that, as used in this specification and the appended claims, the singular forms "a," "an," and "the" include plural referents unless the content clearly dictates otherwise.

"Substrate" or "media substrate" includes any base material that can be coated in accordance with examples of the present disclosure, such as film base substrates, polymer substrates, conventional paper substrates, photobase substrates, offset media substrates, and the like. Further, pre-coated and film coated substrates can be considered a "substrate" that can be likewise be coated in accordance with examples of the present disclosure.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

As a further note, in the present disclosure, it is noted that when discussing the embossed print medium, and the method of preparing the embossed print medium, or the system, each of these discussions can be considered applicable to each of these examples, whether or not they are explicitly discussed in the context of that example. Thus, for example, in discussing details about the embossed print medium per se, such discussion also refers to the method and system, and vice versa.

The following illustrate examples of the disclosure. However, it is to be understood that these examples are merely exemplary or illustrative of the application of the principles of the present disclosure. Numerous modifications and alternative compositions, methods, and systems may be devised by those skilled in the art without departing from the spirit and scope of the present disclosure. The appended claims are intended to cover such modifications and arrangements.

EXAMPLE

Example 1—Characterization of Various Embossed Print Media

An image-receiving layer was prepared to coat various media substrates, such as a polyurethane sheet and wood-free paper. The image-receiving layer was prepared according to the ingredients and amounts listed in Table 1 as Formulation A and coated on the various media substrates. The polyurethane sheet was coated at a coating weight of 5 gsm, and the wood-free paper was coated at a coating weight of 20 gsm. The image-receiving layer was then embossed.

An abrasion-resistant layer was prepared according to the ingredients and amounts listed in Table 2 as Formulation B. The abrasion-resistant layer was coated on the embossed image-receiving layer at a coating weight of 10 gsm.

A PET fabric liner was then applied to the bottom side of the media substrate using an adhesive layer. The adhesive layer used to apply the fabric liner to the media substrate was prepared according to the ingredients and amounts listed in Table 3 as Formulation C.

TABLE 1

Formulation A

| Ingredients | Parts by Weight | Supplier |
|---|---|---|
| Hydrocarb ® 60 | 80 | Omya NA |
| Hydrocarb ® 90 | 20 | Omya NA |
| Acronal ® 866 | 15 | BASF Corporation |
| BYK ®-Dynwet ® 800 | 0.5 | BYK USA, Inc. |
| BYK ® 024 | 0.5 | BYK USA, Inc. |

TABLE 2

Formulation B

| Ingredients | Parts by Weight | Supplier |
|---|---|---|
| Hydrocarb ®60 | 80 | Omya NA |
| Hydrocarb ®90 | 20 | Omya NA |
| Acronal ® 866 | 15 | BASF Corporation |
| Byk-Dynwet ® 800 | 1 | BYK USA, Inc. |
| BYK ®-024 | 0.5 | BYK USA, Inc. |
| Rovene ® 4040 | 8 | Mallard Creek Polymers |
| Araldite ® PZ 3901 | 2.5 | Huntsman Inc |
| Aradur ® 3985 | 2.5 | Huntsman Inc |

TABLE 3

Formulation C

| Ingredients | Parts by Weight | Supplier |
|---|---|---|
| Hydrocarb ®60 | 60 | Omya NA |
| Hydrocarb ®90 | 10 | Omya NA |
| Acronal ® 866 | 15 | BASF Corporation |
| SpaceRite ® S-3 | 30 | J. M. Huber Corp. |

Various embossed print media were prepared as described above and were characterized with respect to embossability, image-quality, image durability, stretchability, and canvas look/feel. The results are depicted in Tables 4 and 5 below.

TABLE 4

| | Media Substrate | Image-Receiving Layer | Abrasion-Resistant Layer | Fabric Liner | Adhesive Layer |
|---|---|---|---|---|---|
| Example A | Polyurethane Sheet | Formulation A, 5 gsm | Formulation B, 10 gsm | PET, 60 gsm | Formulation C, 30 gsm |
| Example B | Wood-free paper, 155 gsm | Formulation A, 20 gsm | Formulation B, 10 gsm | PET, 60 gsm | Formulation C, 30 gsm |

TABLE 4-continued

| | Media Substrate | Image-Receiving Layer | Abrasion-Resistant Layer | Fabric Liner | Adhesive Layer |
|---|---|---|---|---|---|
| Example C | Wood-free paper, 155 gsm | Formulation A, 20 gsm | None | PET, 60 gsm | Formulation C, 30 gsm |
| Example D | Wood-free paper, 155 gsm | None | Formulation B, 10 gsm | PET, 60 gsm | Formulation C, 30 gsm |
| Example E | Wood-free paper, 155 gsm | Formulation A, 20 gsm | Formulation B, 10 gsm | None | N/A |

TABLE 5

| | Embossability | Image Quality | Image Durability | Stretchability | Canvas Look/Feel |
|---|---|---|---|---|---|
| Example A | 5 | 4 | 5 | 5 | 5 |
| Example B | 5 | 5 | 5 | 5 | 5 |
| Example C | 5 | 3 | 1 | 4 | 5 |
| Example D | 3 | 3 | 4 | 5 | 4 |
| Example E | 5 | 5 | 5 | 2 | 1 |

Scale is from 1 to 5 where 1 = Poor and 5 = Excellent.

As illustrate in Tables 4 and 5, the polyurethane sheet having an image-receiving layer coated at 5 gsm and the wood-free paper having an image-receiving layer coated at 20 gsm are fairly comparable with respect the characterization parameters. This shows that it possible to adjust the coating weight of the image-receiving layer based on the "bounce back" of the media substrate to achieve comparable embossed print media.

Further, where either the image-receiving layer or the abrasion-resistant layer was omitted from the embossed print media, the image quality suffered. This illustrates the importance of both layers in providing excellent image quality in the embossed print media.

While adjusting the coating weight of the image-receiving layer can improve the embossability of the embossed print media, the embossed feature is not necessarily durable. This is illustrated more clearly in Example C where the abrasion-resistant layer was omitted. As previously discussed, the abrasion-resistant layer can provide added durability to the embossed print media, and removing this layer can result in a much more fragile embossed feature.

Additionally, where the fabric liner was removed from the embossed print media, both the stretchability and the canvas look/feel suffered. In some aspects, the stretchability can suffer due to the decreased mechanical strength provided by the fabric liner, allowing the embossed print media to tear or break rather than stretching.

This technology has been described with reference to certain examples, and those skilled in the art will appreciate that various modifications, changes, omissions, and substitutions can be made without departing from the spirit of the disclosure. It is intended, therefore, that the present disclosure be limited only by the scope of the following claims.

What is claimed is:

1. An embossed print medium, comprising:

a media substrate having a front side and a back side;

an embossed image-receiving layer formed on the front side of the media substrate at a coating weight of 3 gsm to 50 gsm, wherein the embossed surface has a surface roughness greater than 5 μm, wherein the image-receiving layer comprises a first pigment filler, and a first polymeric binder;

an abrasion-resistant layer applied to the embossed image-receiving layer at a coating weight of from 3 gsm to 50 gsm, wherein the abrasion-resistant layer comprises a second pigment filler and a cross-linked polymer network comprising an epoxy; and a fabric liner applied to the back side of the media substrate with an adhesive layer directly coupling the media substrate to the fabric liner, wherein the adhesive layer has a coating weight of from 20 gsm to 40 gsm, and wherein the adhesive layer comprises a second polymeric binder and a flame-retarding filler.

2. The embossed print medium of claim 1, wherein the cross-linked polymer network further comprises a polyurethane.

3. The embossed print medium of claim 1, wherein the media substrate comprises a polymeric latex.

4. The embossed print medium of claim 1, wherein the first polymeric binder has a weight average molecular weight greater than 10,000 Mw.

5. The embossed print medium of claim 1, wherein the fabric liner comprises from 20 wt % to 90 wt % synthetic fibers and from 10 wt % to 80 wt % natural fibers.

6. The embossed print medium of claim 1, wherein the flame-retarding filler comprises a mineral powder selected from aluminum hydroxide, magnesium hydroxide, huntite, hydromagnesite, hydrates, red phosphorus, boehmite, borates, or combinations thereof.

7. The embossed print medium of claim 1, wherein the embossed print medium is stretchable in one direction by 5% without tearing or cracking.

8. The embossed print medium of claim 1, wherein the embossed surface has a surface roughness from greater than 5 μm to about 15 μm.

9. The embossed print medium of claim 1, wherein the image-receiving layer is embossed to have the appearance of canvas.

10. The embossed print medium of claim 1, wherein the media substrate is a polymeric film.

* * * * *